US009958895B2

(12) United States Patent
Chen et al.

(10) Patent No.: US 9,958,895 B2
(45) Date of Patent: May 1, 2018

(54) BANDGAP REFERENCE APPARATUS AND METHODS

(75) Inventors: Chih-Chia Chen, Taipei (TW); Mark Shane Peng, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 105 days.

(21) Appl. No.: 13/004,617

(22) Filed: Jan. 11, 2011

(65) Prior Publication Data

US 2012/0176186 A1 Jul. 12, 2012

(51) Int. Cl.

*G05F 1/10* (2006.01)
*G05F 3/02* (2006.01)
*G05F 3/30* (2006.01)

(52) U.S. Cl.

CPC ..... *G05F 3/30* (2013.01)

(58) Field of Classification Search

CPC . G05F 3/30; G05F 3/267; G05F 3/262; G05F 3/205; G11C 5/147
USPC ..... 327/539; 323/313, 316
See application file for complete search history.

(56) References Cited

U.S. PATENT DOCUMENTS 5,614,816 A * 3/1997 Nahas ..... 323/316
6,160,319 A * 12/2000 Marougi et al. ..... 307/10.5
6,351,539 B1 * 2/2002 Djakovic ..... 380/268
6,501,256 B1 * 12/2002 Jaussi ..... G05F 3/30 323/315
6,987,416 B2 * 1/2006 Ker ..... G05F 3/30 327/513
7,119,620 B2 * 10/2006 Pan ..... H03F 3/189 323/313
7,204,638 B2 * 4/2007 Hsu ..... G01K 15/00 327/513
7,301,321 B1 * 11/2007 Uang et al. ..... 323/313
7,317,256 B2 * 1/2008 Williams et al. ..... 257/777
7,511,567 B2 * 3/2009 Yeo et al. ..... 327/539
2004/0036460 A1 * 2/2004 Chatal ..... 323/313
2006/0061412 A1 * 3/2006 Molina et al. ..... 327/539
2008/0018319 A1 * 1/2008 Chang et al. ..... 323/315
2009/0051341 A1 * 2/2009 Chang ..... G05F 3/30 323/313
2009/0267194 A1 * 10/2009 Chen ..... 257/621
2010/0007397 A1 * 1/2010 Zhang ..... G05F 3/30 327/262

* cited by examiner

*Primary Examiner* — Quan Tra
(74) *Attorney, Agent, or Firm* — Slater Matsil, LLP

(57) ABSTRACT

Structure and methods for a compensated bandgap reference circuit. A first integrated circuit die having a first bandgap reference circuit with a non-zero temperature coefficient; and having a first output reference signal is provided, a second integrated circuit die having a second bandgap reference circuit with a non-zero temperature coefficient that is of opposite polarity from the temperature coefficient of the first bandgap reference circuit, and having a second output reference signal is provided; an adder circuit disposed on at least one of the first and second integrated circuit dies combines the first and second output reference signals, and outputs a combined reference signal; and connectors for connecting the first and second output signals to the adder circuit are provided. Methods are disclosed for pairing integrated circuit dies with bandgap reference circuits and coupling the dies to form temperature compensated signals.

20 Claims, 8 Drawing Sheets

BANDGAP REFERENCE APPARATUS AND METHODS

BACKGROUND

A common requirement for an advanced electronic circuit and particularly for circuits manufactured as integrated circuits ("ICs") in semiconductor processes is the use of bandgap reference circuits. Bandgap reference circuits provide a current, or voltage, reference that is ideally temperature and process variation independent. A bandgap reference is designed to have a zero temperature coefficient ("TC"). Bandgap reference circuits are an essential component in many analog and mixed signal circuits where a fixed voltage reference or current reference is required. In order to ensure a highly accurate reference from a bandgap reference circuit in integrated circuit devices fabricated in semiconductor processes, test measurements and device trimming procedures are usually performed. The trimming steps are typically done while the devices are still in the form of dies on a semiconductor wafer such as at the chip probe ("CP") or final test ("FT") stages. The trimming is performed to reduce the absolute value error of the reference output, whether voltage or current, due to process variations and first order temperature drift effects. These trimming steps add costs to manufacturing, and add additional testing costs and time to the production of the devices.

Typically, to fabricate a temperature independent circuit, an output that is predictably proportional to absolute temperature ("PTAT") is combined with an output that is complimentary to absolute temperature ("CTAT"). In this manner the output of the circuit is compensated for temperature drift and ideally would provide a reference current, typically, that is temperature independent. An output current can then easily be used to form a reference voltage output that is also temperature independent. However, practical devices remain subject to temperature drift errors and process variations, and thus, trimming has been used to remove any remaining errors. Trimming typically involves laser trimming. This trimming can be used to adjust impedance values in the circuit to compensate for temperature dependent and process dependent errors measured in the bandgap circuit output. However, the use of trimming techniques requires additional pads, which also reduces the available silicon area, and as described above, adds steps and adds costs to the manufacturing process.

A continuing need thus exists for a bandgap reference circuit that has an output that is temperature and process independent for a wide range of expected conditions without the need for trimming. The bandgap reference should be compatible with existing semiconductor processes and circuits.

BRIEF DESCRIPTION OF THE FIGURES

For a more complete understanding of the present invention, and the advantages thereof, reference is now made to the following descriptions taken in conjunction with the accompanying drawings, in which.

The drawings, schematics and diagrams are illustrative and not intended to be limiting, but are examples of embodiments of the invention, are simplified for explanatory purposes, and are not drawn to scale.

DETAILED DESCRIPTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Embodiments of the present application which are now described in detail provide novel methods and apparatus to provide a temperature and process compensated bandgap reference circuit without trimming.

In an embodiment, bandgap reference circuits are compensated by coupling two semiconductor devices each having a bandgap reference circuit, where the devices are selected to have opposite temperature drift effects, and thus, the combined bandgap circuit output is compensated. In an embodiment, stacked devices are coupled. For example, two integrated circuit dies are stacked and coupled together electrically. These dies can be configured to provide a stacked die arrangement including bandgap reference circuits for use with the embodiments. By selecting the top and bottom dies of the two stacked dies using temperature drift measurement results, the two dies may be chosen so that the bandgap reference circuits have opposing temperature drift. The two circuit outputs may be combined in a simple current or voltage adder formed on one of the dies to form a temperature compensated voltage or current output.

In an embodiment, through silicon vias ("TSVs") may be used to couple the circuit outputs between the two dies. In a stacked die arrangement using an interposer, solder bump, or microbumped dies may be arranged on either side of a flip chip interposer for example, and coupled through vias in the interposer. Thus, by adding a positive temperature coefficient output from a bandgap reference circuit to a negative temperature coefficient output from another bandgap reference circuit, and using appropriate weighting, a zero temperature coefficient reference current (or reference voltage) may be obtained without the need for trimming.

Figure 1:
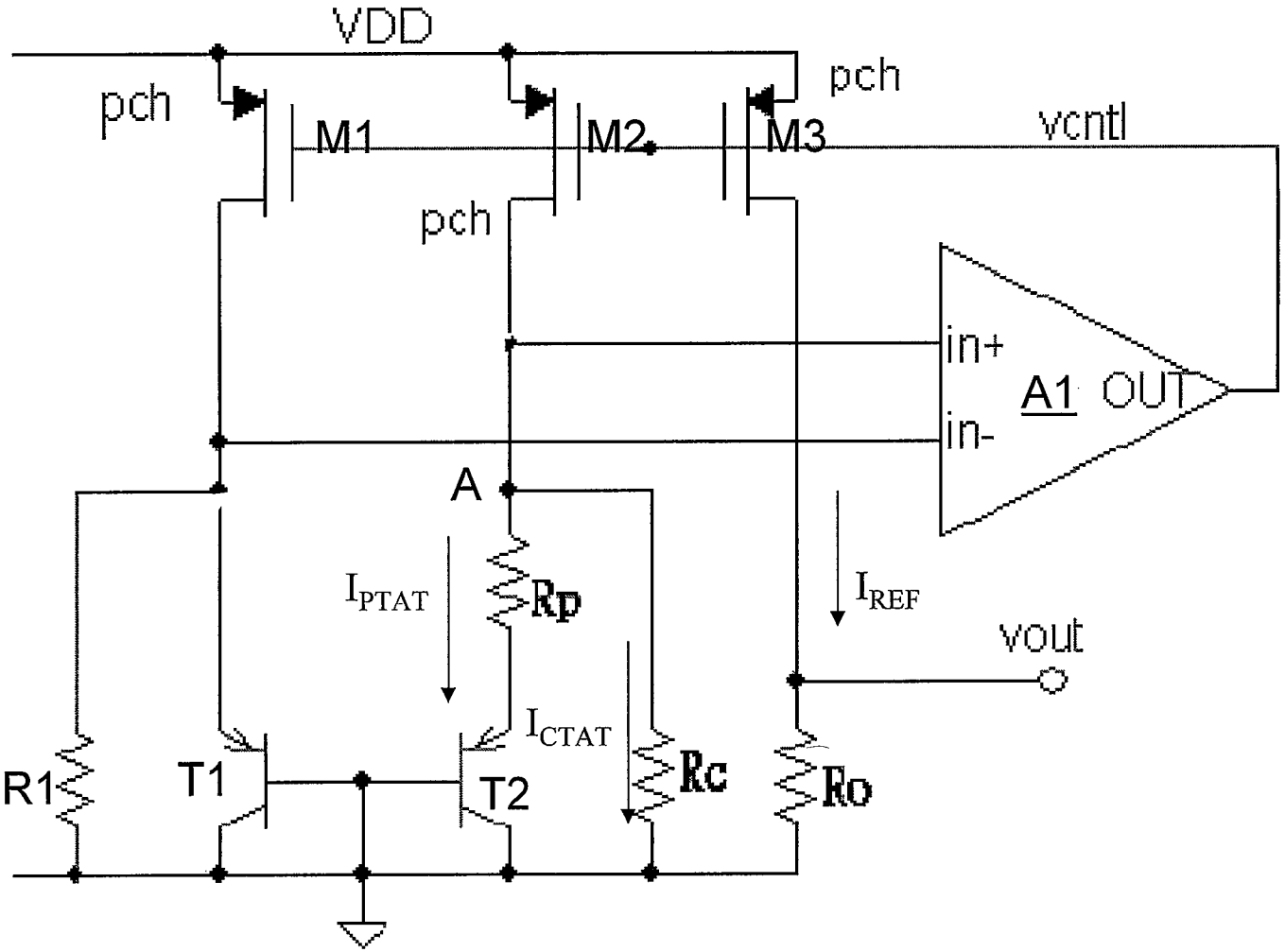
FIG. 1 depicts in a circuit diagram a bandgap reference circuit for use with an embodiment.

FIG. 1 depicts a typical bandgap reference circuit diagram. The output voltage, vout, ideally is a reference voltage that is constant over a range of operating temperatures (it has a zero temperature coefficient or "zero TC"). Typically, an integrated circuit is specified to operate between −40 degrees Celsius to 125 degrees Celsius, for example. In FIG. 1, a comparator amplifier A1 compares a voltage at the "in-" terminal to another voltage at the "in+" terminal. The output forms a control voltage "vcntl" which drives the gate terminals of the P channel MOS transistors M1, M2 and M3. Transistors M1 and M2 act as current sources to the PTAT circuit formed of PNP bipolar transistors T1 and T2, which have their base terminals tied together and to ground and to the collectors, so that they are always on, and the resistor Rp. A current that is proportional to absolute temperature (IPTAT), which has a positive TC, is then flowing through the impedance Rp. A compensating current that is complementary to absolute temperature (ICTAT) is drawn through the resistor Rc. These currents are summed together at node "A". The current into node A is mirrored by the P channel MOS transistor M3. This output current, labeled Iref, is applied to resistor Ro to form the voltage vout. In an ideal case, the current Iref would be constant and temperature independent, as the current IPTAT increases, the current ICTAT decreases, and vice versa, to form a zero TC reference current.

Figure 2:
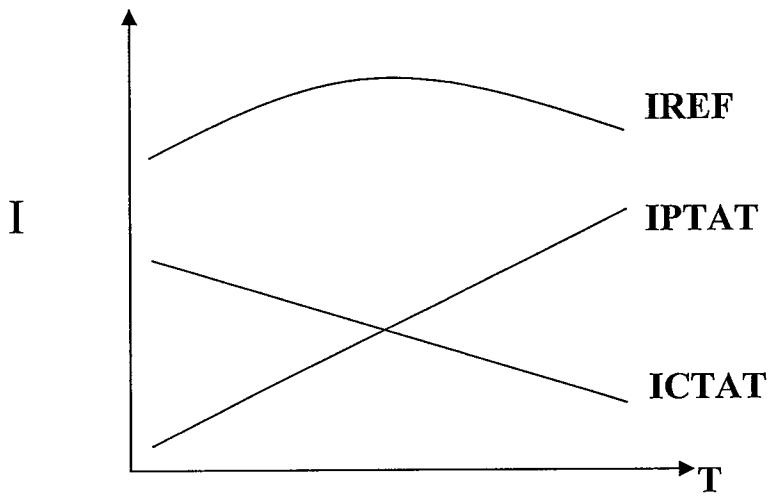
FIG. 2 depicts in a plot three current curves for the bandgap reference circuit of FIG. 1 over a temperature range.

FIG. 2 illustrates a plot of the three currents IPTAT, ICTAT and IREF over a temperature range for a typical bandgap reference circuit such as the one depicted in FIG. 1. The positive TC current IPTAT increases with temperature. The negative TC current ICTAT decreases with rising temperature. As shown in FIG. 2, the reference current IREF is not ideal and thus not perfectly constant over the temperature range, but it does stay within a certain current range over the temperature range.

In a conventional approach, trimming may be used to adjust the response of the bandgap circuits after manufacture. In trimming, mechanical adjustment to impedances using a laser trimmer may be performed, or adjustments to resistor values using antifuse or electrically programmable fuses and impedance arrays, that is electrical trimming, may be performed. In any event, trimming requires additional test pads, additional measurements to confirm the trimming results, and additional time. Trimming may be performed at the wafer probe or contact probe (CP) stage, before the wafers are diced into individual dies, or later in the manufacturing stage, such as at final test (FT) stage. In any event, it is desirable to eliminate trimming and to free up the corresponding extra silicon area needed, as well as to eliminate the extra time or steps needed for manufacture of the devices.

Many semiconductor devices currently being manufactured are intended to be arranged in stacked die, or even stacked package, configurations. As a method for increasing memory density, stacked die packages using identical or almost identical memory dies are well known. Also, to provide processor and memory functions in a single packaged device, stacking memory dies, such as non volatile program memory or even fast access DRAM memory with a microprocessor die is known. Stacking dies is becoming increasingly prevalent as a means to reduce the pin count and number of components on a board or in a device, while also increasing the integration of function and overall computing power of the device.

When dies are stacked, vertical paths coupling the dies together may be formed using, for example, through-silicon-via ("TSV") technology. This vertical connection technology provides a vertical via in a silicon substrate that extends from the bottom surface of a die to the active devices, or sometimes, all the way through the device entirely to form vertical stacking conductors. In any event, two dies stacked together may be electrically coupled using TSVs.

In some alternative embodiment configurations, stacked die packages are formed where the dies are coupled to an interposer, such as a PCB board or a silicon interposer, using thermally reflowable solder bumps or microbumps. The microbumps are small solder bumps formed on the signal pads of the integrated circuit. The IC may then be "flipped" and the solder may be reflowed to form electrical connections to the pads of an interposer. The interposer may offer vertical connections to a die similarly mounted on the opposite side, so that two dies may be coupled vertically through the vias in an interposer. Alternatively, the dies could be mounted in a multiple chip module (MCM) form by mounting them on the same side of an interposer. In this configuration the interposer includes horizontal and vertical conductors to make the electrical connections of the two dies.

When two dies are being used in a combined manner, if both dies have an identical or similar bandgap reference circuit, embodiments herein provide a compensation scheme that does not require trimming. By testing the devices at the contact probe or wafer stage and identifying devices that have positive, and negative, temperature drift and process variations, the devices may be appropriately paired together, and the bandgap circuit outputs may be combined to form a temperature compensated bandgap voltage or current reference.

Figure 3A:
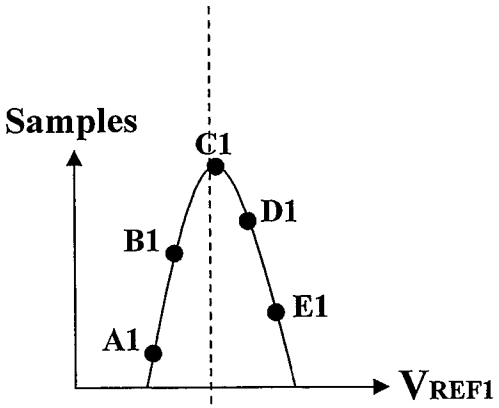
FIG. 3A depicts in a voltage diagram a voltage output measurement for a bandgap reference circuit embodiment implemented on a number of sample dies from a first wafer or lot and FIG. 3B depicts the voltage output measurement for a bandgap reference circuit embodiment implemented on a number of sample dies from a second wafer or lot.
Figure 3B:
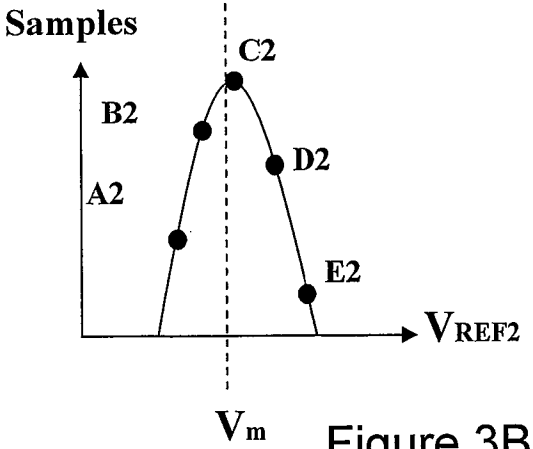

Consider two die configurations, dies that are intended to be the top or upper dies in a stacked die configuration on a first wafer 1, and dies that are intended to be the bottom dies in a stacked configuration formed on a second wafer 2. In FIG. 3A a number of samples are measured and tests plotted for the bandgap circuits. As shown in FIG. 3A for the upper dies on wafer 1, the samples A1 put out a voltage less than desired at a given operational point, samples at point B1 put out a larger voltage, samples at point C1 output a voltage close to the median voltage Vm, and so on for samples at point D1 and E1. Similarly, for the second wafer, samples were plotted for points A2, B2, C2 D2 and E2, as shown in FIG. 3B. In this manner after testing the individual dies on the wafers may be "binned" into a number of groups that have similar temperature drift. While the samples are typically dies on a wafer under test, the samples could be binned as individual dies tested after wafer singulation, or in another embodiment, binned as integrated circuits after packaging if stacked packaged devices are used instead of stacked dies.

By pairing these binned sample devices from the first group with dies taken from the second group, where the pairing is made in a manner that offsets for drift, then the combined circuits may form a temperature and temperature and process compensated output.

Figure 4:
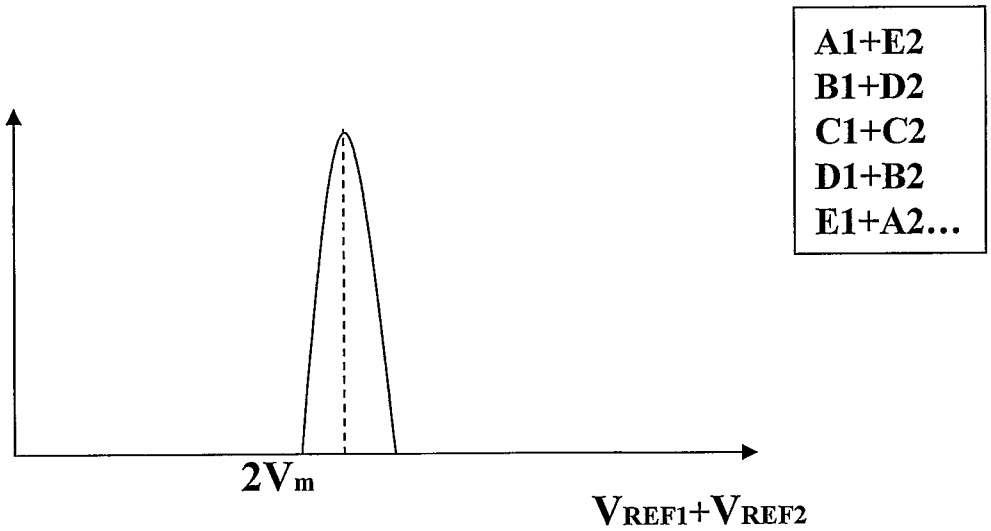
FIG. 4 depicts in a voltage diagram a voltage output for an embodiment formed of a combined pair of devices such as ones taken from the samples of FIGS. 3A and 3B.

FIG. 4 illustrates the output voltage that would be obtained for paired bandgap reference circuits using paired devices chosen from devices from wafer W1 and wafer W2 above. For example, device A1 may be paired with device E2, device B1 could be paired with device D2, etc. By pairing those devices with other devices that exhibit opposing drift, compensation for temperature and process drift may be achieved without the need for trimming.

Figure 5:
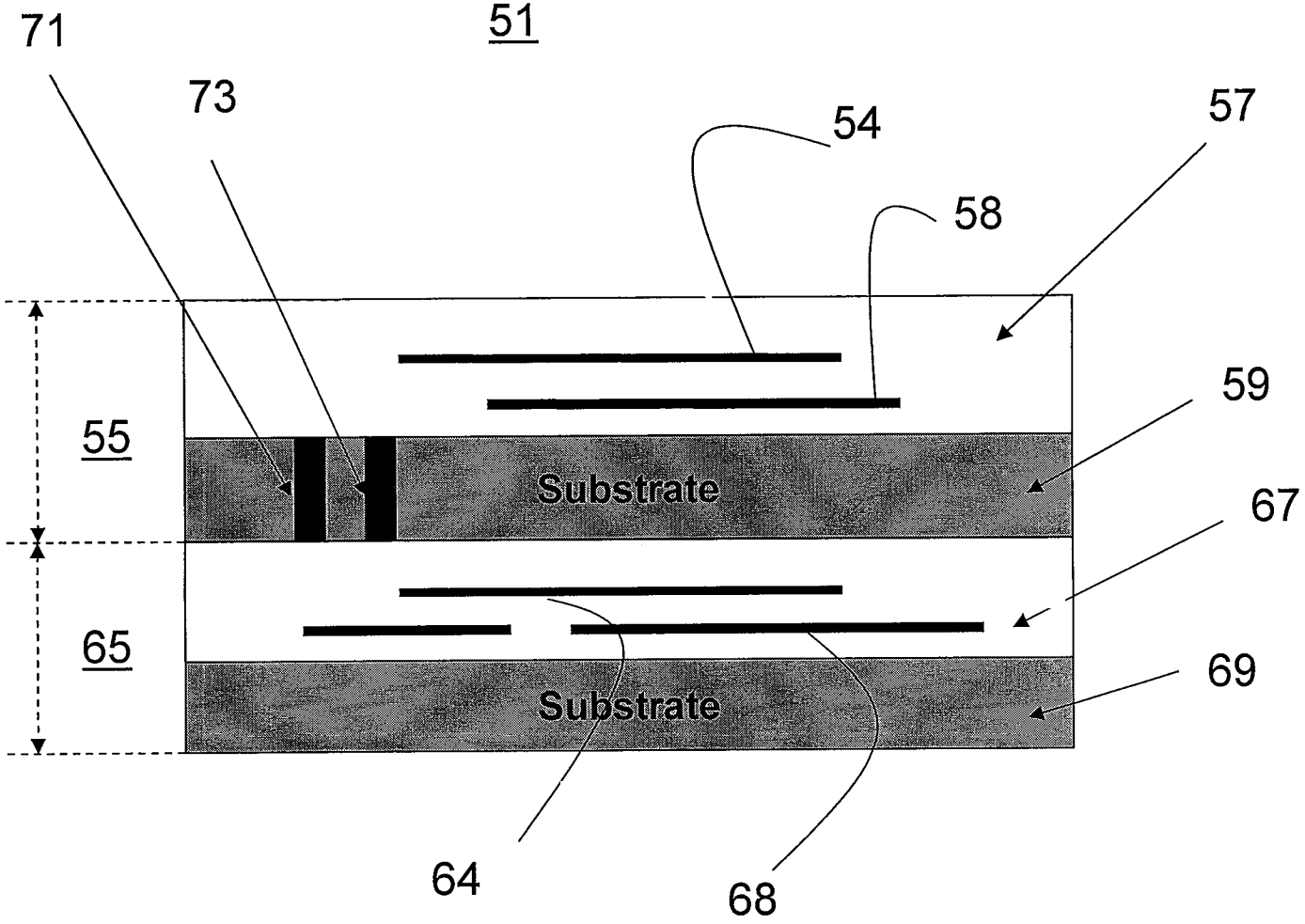
FIG. 5 depicts in a cross sectional view a stacked die embodiment.

FIG. 5 depicts in a simplified cross sectional view two devices shown coupled together in a stacked die configuration 51. In FIG. 5, die 55 is the top die, and die 65 is the bottom die. As will be described below, the circuitry on at least one of these dies includes a voltage, or current, adder to form a combined output signal. The other device does not require this circuitry. In an alternative embodiment design, all of the devices could include the adder circuitry and it would only be enabled for one of the paired devices using a programmation pin, fuse, multiplexer or other selection method. In any event, signals that need to be connected to couple the two bandgap circuits implemented in dies 55 and 65 are connected through the TSVs 71 and 73 that extend through the semiconductor substrate of the upper die, in this case 55. Circuitry 54 and 58 are shown formed in layer 57. These circuits may be formed as metallization layers over the substrate 59, while active devices such as transistors formed in the semiconductor substrates, not visible here, are also coupled to the metallization circuitry. Die 65, the bottom die, has similar circuitry 64 and 68 formed in the layers 67 overlying substrate 69 which also includes active devices, not visible here. The two stacked dies are coupled together to form a completed device. TSVs 71 and 73 are shown as examples; many more may be used to couple the devices 55 and 65.

Figure 6:
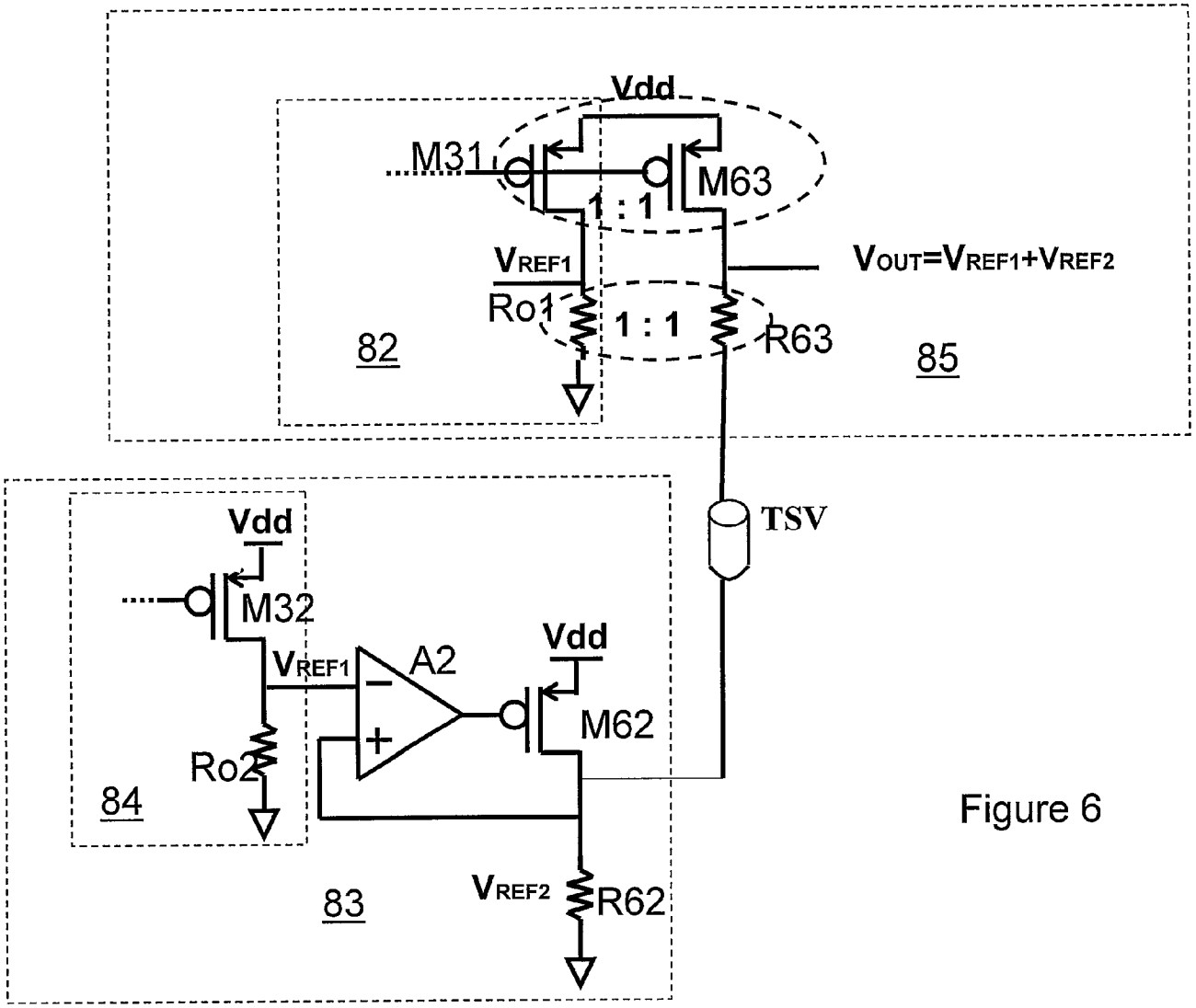
FIG. 6 depicts in a circuit diagram a voltage adder embodiment.

In order to combine the outputs of two bandgap reference circuits in the embodiments, adder circuitry may be provided in one of the two devices of a pair of devices. FIG. 6 depicts a voltage adder embodiment circuit diagram. In FIG. 6, a voltage reference circuit 83 is formed on a bottom die, for example. A portion of the bandgap reference, 84, corresponds to the bandgap reference circuit in FIG. 1. The P channel device M32 and the impedance Ro2 correspond to the PMOS device M3 and the output resistor Ro in FIG. 1. For the bandgap reference circuit, the remainder of the bandgap circuit 84 is not illustrated, for simplicity. An output buffer circuit is formed of an amplifier A2, a PMOS transistor M62, and a resistor R62. This circuit isolates the bandgap reference circuit on the bottom device from the adder circuit, and provides an output Vref2.

In FIG. 6, a second bandgap reference circuit 85 is shown having portions M31 and Ro1 forming an output circuit 82 which correspond to the output portion of a bandgap reference circuit of FIG. 1. Again, the remaining portions of the bandgap circuit are omitted for simplicity, now implemented on the top die of the stacked die pair. A scaling circuit is formed by PMOS transistor M63 and resistor R63. By changing the size ratios of transistors M63 to M31, and the value ratios of resistor R63 to R01, it is possible to scale the output voltage Vref1 as needed. The TSV element of FIG. 6 couples the output voltage Vref2 from the bottom die reference circuit 83 to the output voltage Vout, and the adder then sums the voltages Vref1 and Vref2 together. By pairing the two devices where the circuits 85 and 83 are implemented to offset the temperature drift, that is, by choosing one positive TC device and one negative TC device with similar offset values, the output Vout is compensated without trimming. The scaling devices may be used to further adjust the voltages as needed to obtain the correct output voltage Vout.

Figure 7:
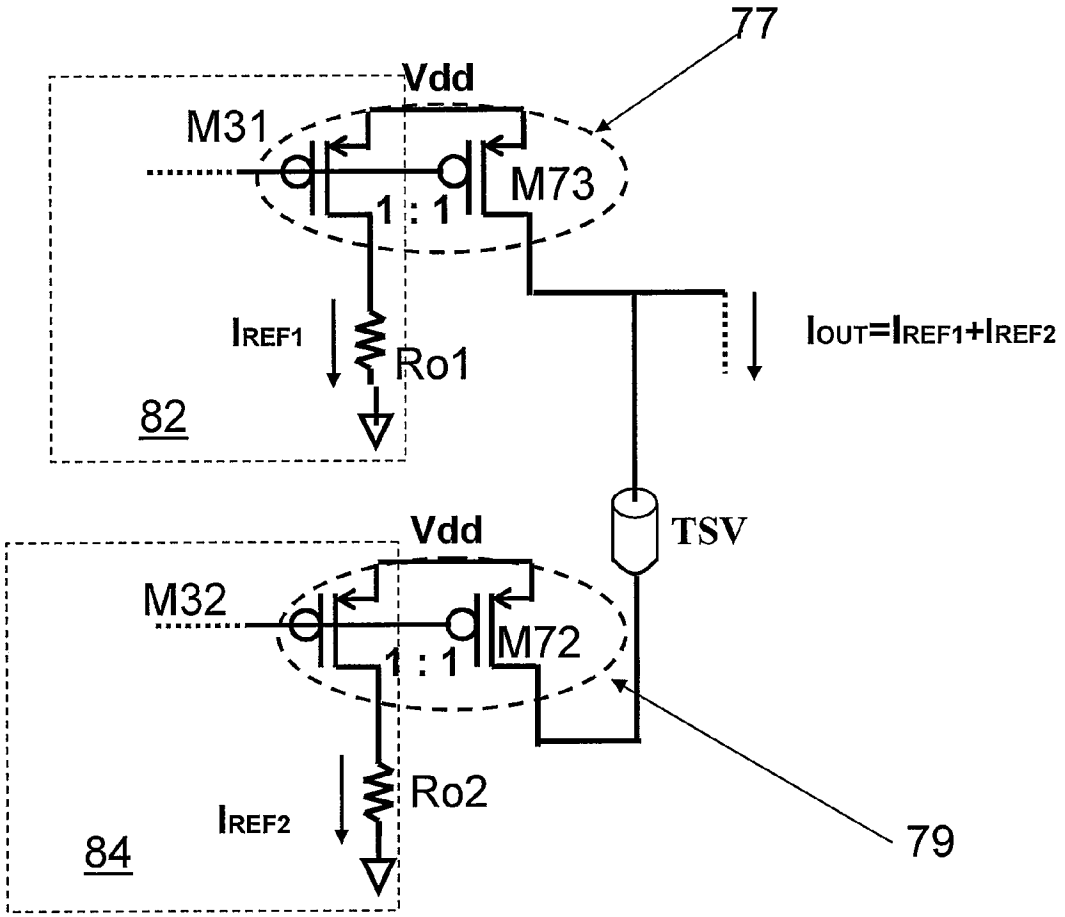
FIG. 7 depicts in a circuit diagram a current adder embodiment.

FIG. 7 depicts an embodiment current output adder circuit. Upper die reference circuit 82 again illustrates a portion of the bandgap reference circuit, the output portion, including transistor M31 and resistor Ro1. The remaining portions of the bandgap circuit are not shown for clarity. The lower die reference circuit 84 illustrates a portion of the bandgap reference circuit, transistor M32 and resistor Ro2, as before. Transistor M73, on the upper die, provides a current mirror that outputs current Iref1 to the output and transistor M72 provides the current Iref2 at an output on the lower die. These currents are added together at the upper die to form Iout, and the TSV in FIG. 7 couples the circuits together. Dashed area 77 indicates that the transistors M31 and M73 act as a scaling circuit; in this non-limiting example, the scale is 1:1. Dashed area 79 similarly indicates that the transistors M32 and M72 can scale current Iref2; in this non-limiting example, the scale is 1:1. By selecting the upper die device and the lower die device to have opposing offset polarity temperature coefficients TC, the output current Iout can be made to have a near zero TC. In addition, the scaling circuits make it possible to further adjust the individual weighting factors on currents Iref1 and Iref2.

Figure 8:
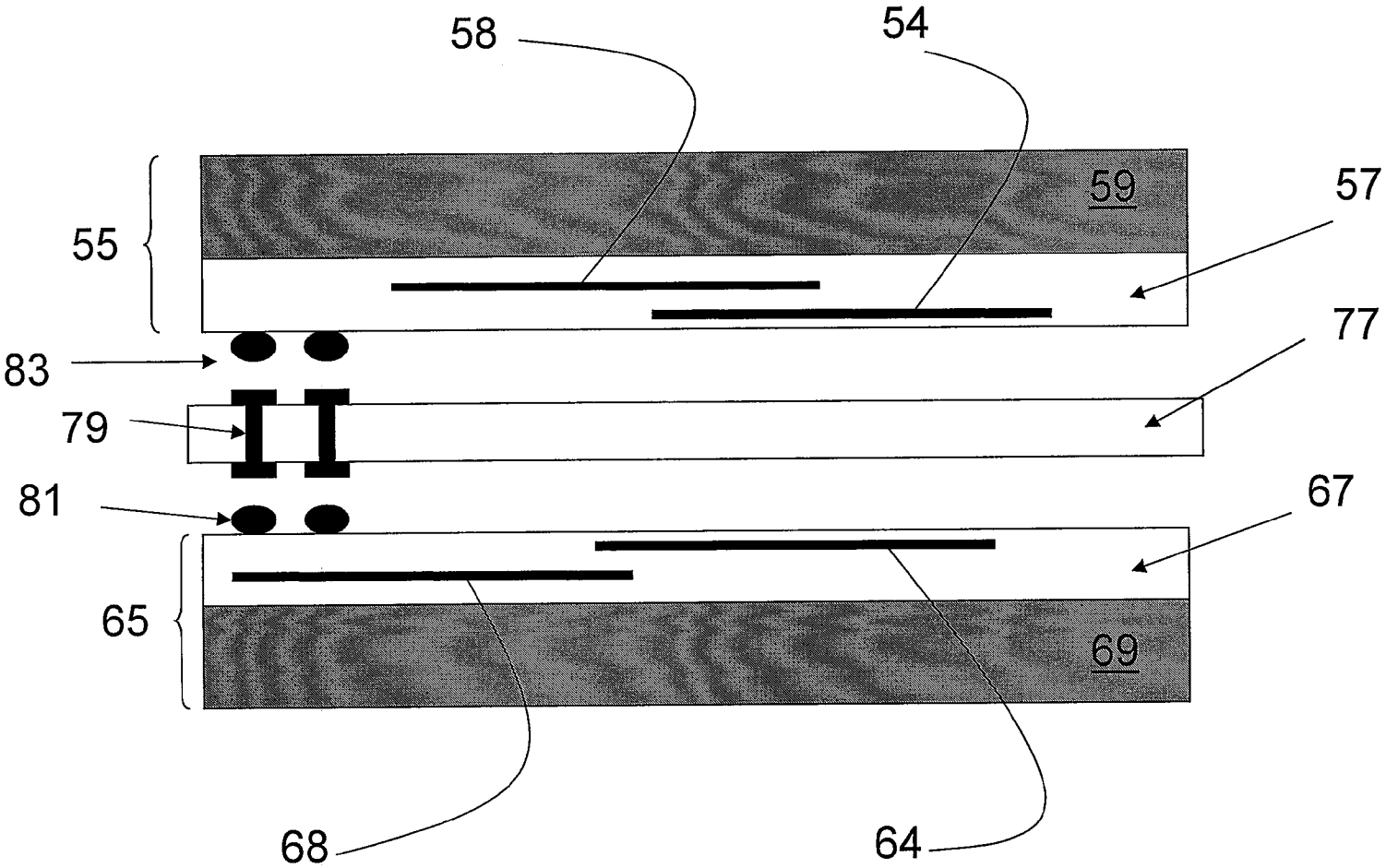
FIG. 8 depicts in a cross sectional view a flip chip and interposer embodiment.

FIG. 8 depicts in a cross sectional view an alternative embodiment using an interposer and flip chip approach to couple the circuits on the pair of dies. Upper die 55 is shown again formed of substrate 59 and circuits 58 and 54, in layer 57, but now this die is flipped over and facing an interposer 77. Solder bumps 83, which may be small enough to be considered microbumps, are shown aligned with the interposer conductors 79. Interposer 77 may be formed of PCB material, silicon, other semiconductor material, flexible substrates or films, that provide electrical isolation and through one or more layers of conductors, conductive paths from one side to the other as are known to those skilled in the art. Similarly, lower die 65 is now shown positioned below interposer 77 and having solder bump or microbumps 81 aligned with the interposer conductors 79. Die 65 again includes circuitry 64 and 68 in layer 67, and substrate 69, arranged as before. By coupling the outputs of the bandgap reference circuits on the lower die to the microbumps 81 and on the upper die to the microbumps 83 and, using solder reflow connections, completing a physical and electrical connection to the interposer 77, the two bandgap reference circuits may be connected by the interposer instead of the TSV shown in FIG. 5.

In an embodiment, an apparatus comprises a first integrated circuit die having a first bandgap reference circuit with a non-zero temperature coefficient; and having a first output reference signal; a second integrated circuit die having a second bandgap reference circuit with a non-zero temperature coefficient that is of opposite polarity from the temperature coefficient of the first bandgap reference circuit, and having a second output reference signal; an adder circuit disposed on at least one of the first and second integrated circuit dies for combining the first and second output reference signals, and outputting a combined reference signal; and connectors for connecting the first and second output signals to the adder circuit.

In an embodiment, an apparatus comprises a first semiconductor die having a first bandgap reference circuit with a non-zero temperature coefficient, and having a first output reference signal; an adder circuit disposed on the first semiconductor die for combining the first output reference signal with a second output reference signal, and outputting an added reference signal that is temperature compensated; at least one solder bump disposed on a surface of the first semiconductor die and electrically coupled to the adder circuit for receiving the second output reference signal; a second semiconductor die having a second bandgap reference circuit with a non-zero temperature coefficient of opposite polarity to the temperature coefficient of the first bandgap reference circuit, and outputting the second output reference signal; at least one solder bump disposed on a surface of the second semiconductor die and electrically coupled to the second output reference signal; and an interposer disposed between the first and second semiconductor dies having at least one via conductor aligned with and in contact with the solder bumps, the at least one via conductor electrically connecting the first and second semiconductor dies.

In an embodiment, a method comprises providing a first plurality of semiconductor dies each having a first bandgap reference circuit for outputting a reference signal; providing a second plurality of semiconductor dies each having a second bandgap reference circuit for outputting a reference signal; determining via probe testing the temperature coefficient for each die of the first and the second plurality of semiconductor dies; sorting the semiconductor dies into first groups from the first plurality with temperature coefficients of similar polarity, and into second groups from the second plurality with temperature coefficients of similar polarity; pairing one of the semiconductor dies of the first group with one of the semiconductor dies of the second group to form a pair of dies so that the bandgap reference circuits of the pair of semiconductor dies has offsetting temperature coefficients; and coupling the outputs of the bandgap reference circuits on the paired ones of the first and second plurality of semiconductor dies to an adder circuit provided on one of the paired semiconductor dies, the adder circuit outputting a temperature compensated reference signal.

Moreover, the scope of the present application is not intended to be limited to the particular embodiments of the structures, methods and steps described in the specification. As one of ordinary skill in the art will readily appreciate from the disclosure of the present invention, processes, or steps, presently existing or later to be developed, that perform substantially the same function or achieve substantially the same result as the corresponding embodiments described herein may be utilized according to the present invention. Accordingly, the appended claims are intended to include within their scope such processes or steps.

What is claimed is:

1. An apparatus, comprising:

a first integrated circuit die having a first bandgap reference circuit comprising temperature compensated circuitry with a first non-zero temperature drift coefficient, the temperature compensated circuitry comprising a proportional to absolute temperature circuit element and a complementary to absolute temperature circuit element, the first bandgap reference circuit outputting a first output reference signal with a first temperature drift coefficient and based on signals generated by the proportional to absolute temperature circuit element and by the complementary to absolute temperature circuit element, wherein the proportional to absolute temperature circuit element comprises a first bipolar transistor and a second bipolar transistor, wherein the first bipolar transistor is in parallel with a first resistor and wherein the second bipolar transistor is in parallel with a resistor of the complementary to absolute temperature circuit element;

a second integrated circuit die having a second bandgap reference circuit comprising temperature compensated circuitry with a second non-zero temperature drift coefficient that is of opposite polarity from the first non-zero temperature drift coefficient of the first bandgap reference circuit, wherein the second bandgap reference circuit has a first structure and the first bandgap reference circuit has the first structure, the temperature compensated circuitry comprising a proportional to absolute temperature circuit element and a complementary to absolute temperature circuit element, the second bandgap reference circuit outputting a second output reference signal with a second temperature drift coefficient approximately equal to and of opposite polarity to the first temperature drift coefficient, the second output reference signal based on signals generated by the proportional to absolute temperature circuit element and by the complementary to absolute temperature circuit element;

a first adder circuit disposed on the first integrated circuit die for combining the first and second output reference signals, and outputting a combined reference signal that is temperature compensated by the combined offset between the first and second temperature drift coefficients, wherein the first adder circuit is connected to the a first bandgap reference circuit comprising temperature compensated circuitry and the second bandgap reference circuit comprising temperature compensated circuitry through a first selection device;

connectors for connecting the first and second output reference signals to the first adder circuit, and a second adder circuit disposed on the second integrated circuit die, wherein the second adder circuit is disconnected to the first bandgap reference circuit comprising temperature compensated circuitry and the second bandgap reference circuit comprising temperature compensated circuitry through a second selection device.

2. The apparatus of claim 1, wherein the adder circuit is disposed on the first integrated circuit die, and wherein the second bandgap reference circuit comprising temperature compensated circuitry and the first bandgap reference circuit comprising temperature compensated circuitry are free from trimming damage.

3. The apparatus of claim 1, wherein the first and second integrated circuit dies are stacked dies.

4. The apparatus of claim 3, wherein at least one of the connectors comprises a through silicon via ("TSV").

5. The apparatus of claim 1, wherein the first bandgap circuit has a positive first non-zero temperature drift coefficient.

6. The apparatus of claim 1, wherein the first bandgap circuit has a negative first non-zero temperature drift coefficient.

7. The apparatus of claim 1, wherein the first and second bandgap circuits output reference currents.

8. The apparatus of claim 1, wherein the first and second bandgap circuits output reference voltages.

9. The apparatus of claim 8, wherein the adder circuit comprises a voltage adder.

10. The apparatus of claim 7, wherein the adder circuit comprises a current adder.

11. An apparatus comprising:

a first semiconductor die having a first bandgap reference circuit comprising temperature compensated circuitry with a first non-zero temperature drift coefficient, the temperature compensated circuitry comprising at least one of a proportional to absolute temperature circuit element or a complementary to absolute temperature circuit element, and the first bandgap reference circuit having a first output reference signal, the first output reference signal approximating a first voltage and having a first temperature drift coefficient;

a first adder circuit disposed on the first semiconductor die, the first adder comprising a first output;

a second adder circuit disposed on a second semiconductor die, the second adder comprising a second output different from the first output, wherein only one of the first adder circuit and the second adder circuit is enabled for combining the first output reference signal with a second output reference signal approximating the first voltage, the second output reference signal having a second temperature drift coefficient approximately equal to and of opposite polarity to the first temperature drift coefficient, the one of the first adder circuit and the second adder circuit that is enabled outputting an added reference signal that is temperature compensated by the combined offset between the first and second temperature drift coefficients, wherein the one of the first adder circuit and the second adder circuit that is enabled comprises a scaling circuit, the scaling circuit comprising a first transistor and a resistor, wherein the first transistor and a second transistor within the first bandgap reference circuit have a size ratio that scales an output voltage, the second one of the first adder circuit and second adder circuit being disabled by a programmation pin, a fuse, or a multiplexer;

at least one solder bump disposed on a surface of the first semiconductor die and electrically coupled to the adder circuit for receiving the second output reference signal;

a second bandgap reference circuit on the second semiconductor die, the second bandgap reference circuit being identical to the first bandgap reference circuit, the second bandgap reference circuit comprising temperature compensated circuitry with a second non-zero temperature drift coefficient of opposite polarity to the first non-zero temperature drift coefficient of the first bandgap reference circuit, the temperature compensated circuitry comprising a proportional to absolute temperature circuit element and a complementary to absolute temperature circuit element, and the second bandgap reference circuit outputting the second output reference signal;

at least one solder bump disposed on a surface of the second semiconductor die and electrically coupled to the second output bandgap reference circuit; and an interposer disposed between the first and second semiconductor dies having at least one via conductor aligned with and in contact with the solder bumps, the at least one via conductor electrically connecting the first and second semiconductor dies.

12. The apparatus of claim 11, wherein the adder circuit is a voltage adder.

13. The apparatus of claim 11, wherein the adder circuit is a current adder.

14. The apparatus of claim 12, wherein the first and second output reference signals are voltages.

15. The apparatus of claim 13, wherein the first and second output reference signals are currents.

16. A method, comprising:

providing a first plurality of semiconductor dies each having a first bandgap reference circuit comprising first temperature compensated circuitry comprising a proportional to absolute temperature circuit element and a complementary to absolute temperature circuit element, the first bandgap reference circuit outputting a first bandgap reference signal that approximates a first voltage and that is based, at least in part, on a signal generated by the proportional to absolute temperature circuit element and the complementary to absolute temperature circuit element of the first bandgap reference circuit;

providing a second plurality of semiconductor dies each having a second bandgap reference circuit comprising second temperature compensated circuitry comprising a proportional to absolute temperature circuit element and a complementary to absolute temperature circuit element, wherein the second bandgap reference circuit and the first band gate reference circuit have a same structure, the second bandgap reference circuit outputting a second bandgap reference signal that approximates the first voltage and that is based, at least in part, on a signal generated by the proportional to absolute temperature circuit element and the complementary to absolute temperature circuit element of the second bandgap reference circuit;

determining the temperature drift coefficient for each die of the first plurality of semiconductor dies and each die of the second plurality of semiconductor dies;

sorting the first plurality of semiconductor dies into first groups wherein dies of each group of the first groups each have temperature drift coefficients of a similar magnitude and polarity;

sorting the second plurality of semiconductor dies into second groups wherein dies of each group of the second groups each have temperature drift coefficients of a similar magnitude and polarity;

pairing a first die of the semiconductor dies of the first groups with a second die of the semiconductor dies of the second groups to form a pair of dies, wherein the temperature drift coefficient of the first die is approximately equal to, and opposite polarity of, the temperature drift coefficient of the second die, and wherein the bandgap reference circuits of the pair of dies have substantially offsetting temperature drift coefficients; and coupling the output of each of the bandgap reference circuits on the pair of dies to an adder circuit provided on at least one die of the paired dies, the adder circuit outputting a temperature compensated reference signal, wherein after the coupling the output of each bandgap reference circuits to the adder circuit, the first bandgap reference circuit has only a single output to the adder circuit and the second bandgap reference circuit, wherein the reference signal is formed without trimming.

17. The method of claim 16 and further comprising:

stacking one of the semiconductor dies in the pair of dies over the other one of the semiconductor dies in the pair;

forming at least one through silicon via in the top one of the pair of stacked semiconductor dies; and electronically coupling the output of the bandgap reference circuit in the bottom one of the pair of dies to the adder circuit using the through silicon via.

18. The method of claim 16 and further comprising:

providing a flip chip interposer having at least one via for coupling signals through the interposer;

disposing one of the semiconductor dies in the pair of dies over one side of the flip chip interposer and aligning a solder bump on the semiconductor die of the at least one via;

disposing the other one of the semiconductor dies in the pair of dies over the opposite side of the flip chip interposer and aligning a solder bump on the other semiconductor die with the same at least one via; and electronically coupling the output of the bandgap reference circuit on the other one of the semiconductor dies to the adder circuit using the solder bumps and the at least one via through the flip chip interposer.

19. The method of claim 16, wherein outputting the reference signals comprises outputting currents.

20. The method of claim 16, wherein the coupling comprises programming a selection device to disconnect a second adder circuit provided on one of the at least one die of the paired dies.

* * * * *